US011139091B2

(12) United States Patent
Cho et al.

(10) Patent No.: US 11,139,091 B2
(45) Date of Patent: Oct. 5, 2021

(54) RESISTOR COMPONENT

(71) Applicant: SAMSUNG ELECTRO-MECHANICS CO., LTD., Suwon-si (KR)

(72) Inventors: Ah Ra Cho, Suwon-si (KR); Ji Sook Yoon, Suwon-si (KR); Kwang Hyun Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/908,391

(22) Filed: Jun. 22, 2020

(65) Prior Publication Data

US 2021/0183544 A1 Jun. 17, 2021

(30) Foreign Application Priority Data

Dec. 12, 2019 (KR) ..... 10-2019-0165358

(51) Int. Cl.

| | |
|---|---|
| ***H01C 1/148*** | (2006.01) |
| ***H01C 7/00*** | (2006.01) |
| ***H01C 17/065*** | (2006.01) |
| ***H01C 1/01*** | (2006.01) |

(52) U.S. Cl.

CPC ..... *H01C 1/148* (2013.01); *H01C 1/01* (2013.01); *H01C 7/003* (2013.01); *H01C 17/06506* (2013.01)

(58) Field of Classification Search

CPC ..... H01C 1/148; H01C 1/142; H01C 7/003; H01C 17/065; H01C 17/06506

See application file for complete search history.

(56) References Cited

U.S. PATENT DOCUMENTS 5,111,179 A * 5/1992 Flassayer ..... H01C 1/142 338/272
5,563,572 A * 10/1996 Hetzler ..... H01C 13/02 338/254
9,460,834 B2 * 10/2016 Croci ..... G01L 25/00

(Continued)

FOREIGN PATENT DOCUMENTS

JP 2018-152487 A 9/2018
JP 2019-079963 A 5/2019

(Continued)

OTHER PUBLICATIONS

Korean Office Action dated Nov. 13, 2020 issued in Korean Patent Application No. 10-2019-0165358 (with English translation).

*Primary Examiner* — Kyung S Lee

(74) *Attorney, Agent, or Firm* — Morgan, Lewis & Bockius LLP

(57) ABSTRACT

A resistor component includes an insulating substrate, a resistor layer disposed on one surface of the insulating substrate and having one end and the other end opposing each other in a first direction, and first and second terminals disposed on the insulating substrate and spaced apart from each other to oppose each other in a second direction perpendicular to the first direction, and connected to the resistor layer. A slit in the resistor layer extends in the first direction, and a ratio of a length of the slit in the first direction to a length of the resistor layer in the first direction is greater than 0.7 and equal to or lower than 0.9.

13 Claims, 4 Drawing Sheets

I-I'

(56) References Cited

U.S. PATENT DOCUMENTS

| | | | | |
|---|---|---|---|---|
| 9,514,867 | B2 * | 12/2016 | Harada | H01C 1/08 |
| 9,704,621 | B2 * | 7/2017 | Ogawa | H01C 17/006 |
| 10,008,310 | B1 | 6/2018 | Ryu et al. | |
| 2005/0275503 | A1 * | 12/2005 | Yoneda | H01C 17/006 338/309 |
| 2009/0040011 | A1 * | 2/2009 | Yoneda | H01C 1/012 338/309 |
| 2009/0237200 | A1 * | 9/2009 | Yoneda | H01C 7/003 338/307 |
| 2012/0235782 | A1 * | 9/2012 | Chen | H01C 17/006 338/309 |
| 2016/0240291 | A1 * | 8/2016 | Tanaka | H01C 7/20 |

FOREIGN PATENT DOCUMENTS

| | | | |
|---|---|---|---|
| KR | 10-0769455 | B1 | 10/2007 |
| KR | 10-2017-0074365 | A | 6/2017 |
| KR | 10-2017-0083335 | A | 7/2017 |
| KR | 10-2018-0093461 | A | 8/2018 |

* cited by examiner

I-I'

RESISTOR COMPONENT

CROSS-REFERENCE TO RELATED APPLICATION(S)

This application claims benefit of priority to Korean Patent Application No. 10-2019-0165358 filed on Dec. 12, 2019 in the Korean Intellectual Property Office, the disclosure of which is incorporated herein by reference in its entirety.

TECHNICAL FIELD

The present disclosure relates to a resistor component.

BACKGROUND

A resistor component is a passive electronic component for implementing a precision resistor. A resistor component may adjust a current and may increase or decrease a voltage in an electronic circuit.

In the case of a general resistor component, a resistor layer may be formed by applying a paste for a resistive element to an insulating substrate and sintering the paste. A surface of the resistor layer after the sintering, however, may not be relatively uniform due to fluidity of the paste for a resistive element and dispersion and grain growth in the sintering, which may adversely affect the controlling of a resistance value of the resistor layer.

SUMMARY

An aspect of the present disclosure is to provide a resistor component of which a resistance value may be precisely controlled.

Another aspect of the present disclosure is to provide a resistor component having improved withstand voltage properties.

According to an aspect of the present disclosure, a resistor component includes an insulating substrate, a resistor layer disposed on one surface of the insulating substrate and having one end and the other end opposing each other in a first direction, and first and second terminals disposed on the insulating substrate and spaced apart from each other to oppose each other in a second direction perpendicular to the first direction, and connected to the resistor layer. A slit in the resistor layer extends in the first direction, and a ratio of a length of the slit in the first direction to a length of the resistor layer in the first direction is greater than 0.7 and equal to or lower than 0.9.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
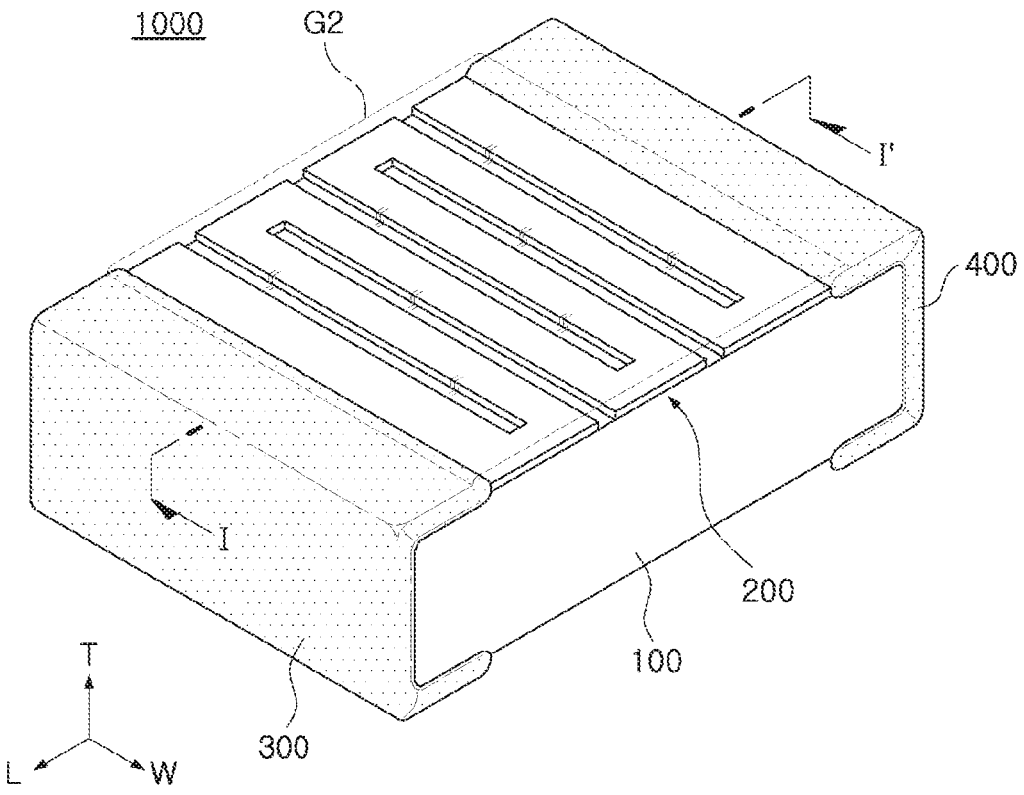
FIG. 1 is diagram illustrating a resistor component according to an example embodiment of the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method (s) and/or the tool (s) described in the present disclosure. The present disclosure, however, is not limited thereto. Other methods and/or tools appreciated by one of ordinary skill in the art, even if not described in the present disclosure, may also be used.

In the drawings, a W direction is a first direction or a width direction, an L direction is a second direction or a length direction, and a T direction is a third direction or a thickness direction.

In the descriptions described with reference to the accompanied drawings, the same elements or elements corresponding to each other will be described using the same reference numerals, and overlapped descriptions will not be repeated.

Figure 2:
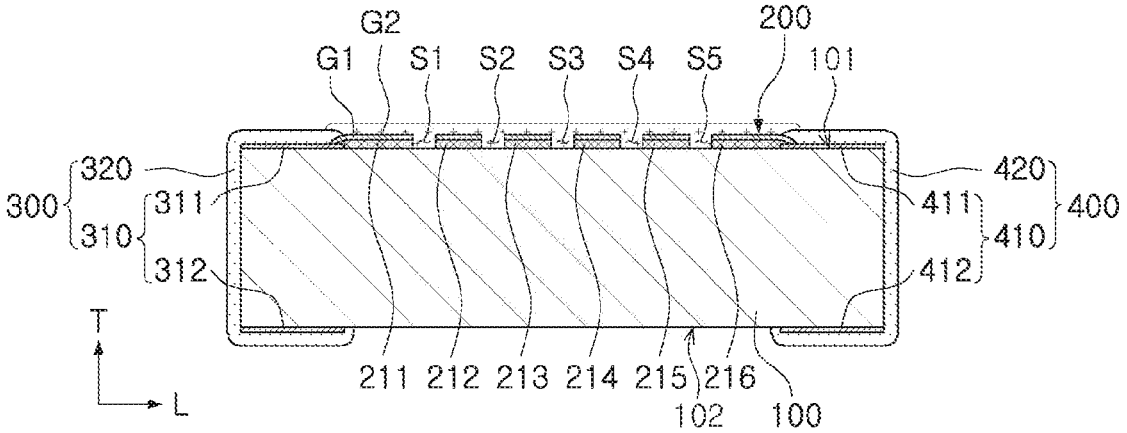
FIG. 2 is a cross-sectional diagram along line I-I' in FIG. 1.
Figure 3:
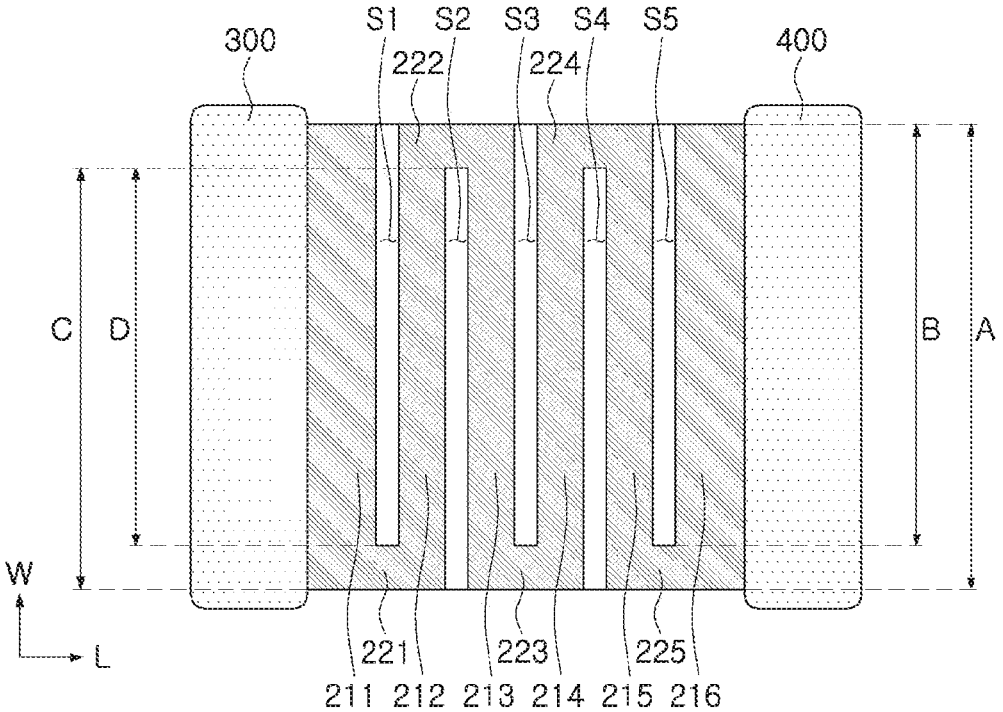
FIG. 3 is a plan diagram illustrating a resistor component according to an example embodiment of the present disclosure.
Figure 4A:
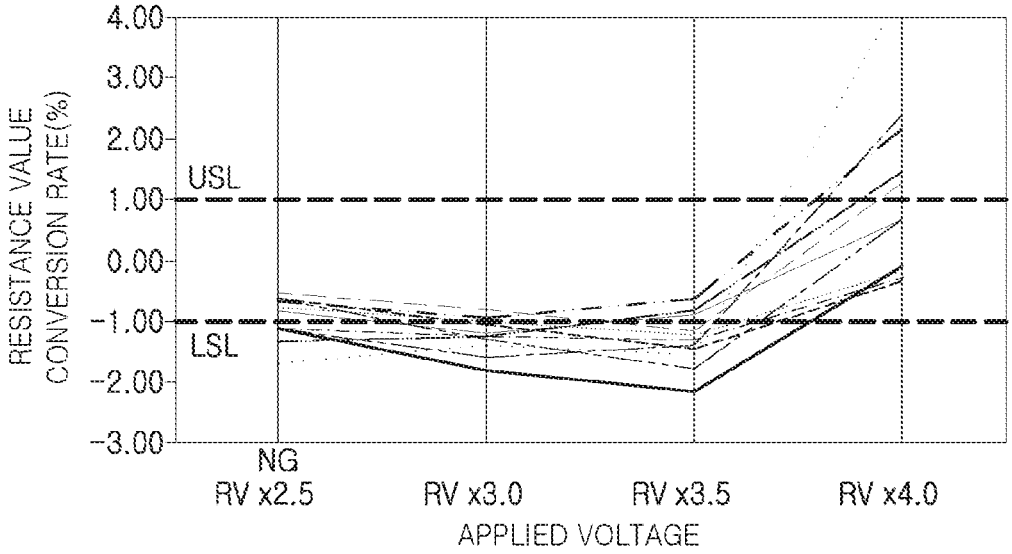
FIGS. 4A, 4B, and 4C are diagrams illustrating changes in resistance value conversion rate of a resistor component according to an applied voltage in accordance with a length of a slit.
Figure 4B:
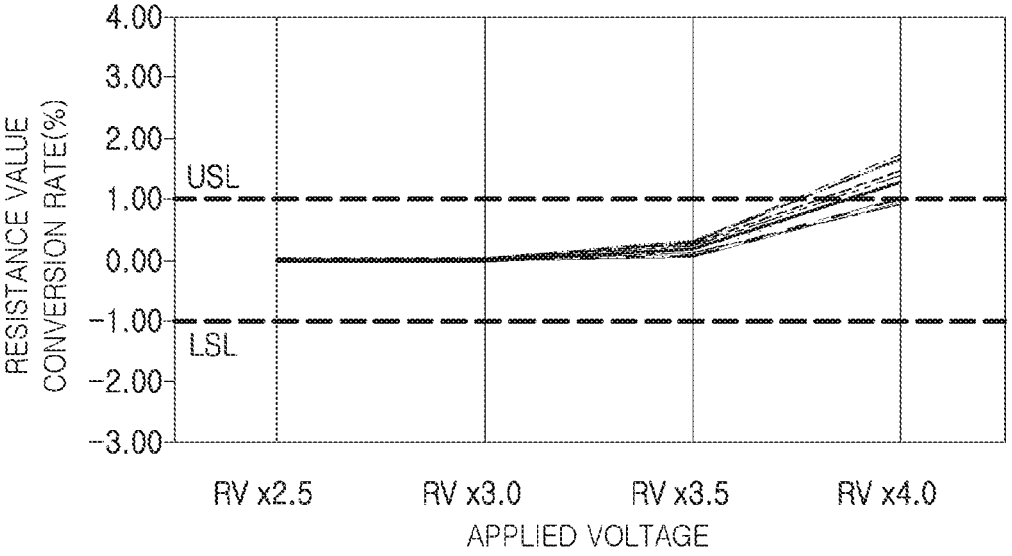
Figure 4C:
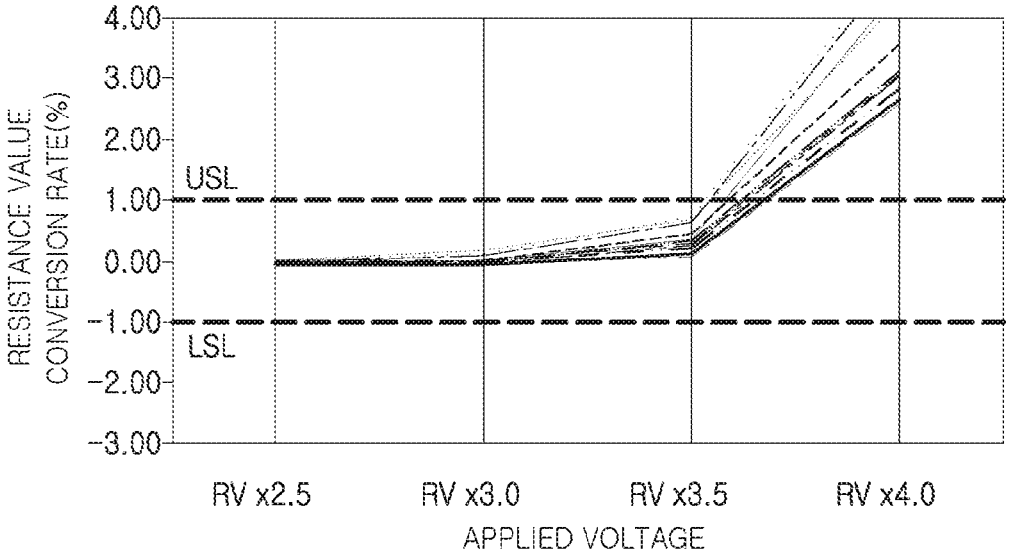

FIG. 1 is diagram illustrating a resistor component according to an example embodiment. FIG. 2 is a cross-sectional diagram along line I-I' in FIG. 1. FIG. 3 is a plan diagram illustrating a resistor component according to an example embodiment. FIGS. 4A, 4B, and 4C are diagrams illustrating changes in resistance value conversion rate of a resistor component according to an applied voltage in accordance with a length of a slit. For ease of description, in FIG. 1, a first protective layer is not illustrated, and in FIG. 3, first and second protective layers are not illustrated.

Referring to FIGS. 1 to 4C, a resistor component 1000 in the example embodiment may include an insulating substrate 100, a resistor layer 200, and first and second terminals 300 and 400. The resistor layer 200 may include slits S1, S2, S3, S4, and S5, although the number of the slits is not limited to 5 and may be more than or less than 5.

The insulating substrate 100 may have a plate shape having a predetermined thickness, and may include a material for effectively emitting heat generated from the resistor layer 200. The insulating substrate 100 may include a ceramic material such as alumina ($Al_2O_3$), but an example embodiment thereof is not limited thereto. The insulating substrate 100 may include a polymer material. As an example, the insulating substrate 100 may be configured as an alumina insulating substrate obtained by anodizing a surface of aluminum, but an example embodiment thereof is not limited thereto. The insulating substrate 100 may be configured as a sintered alumina substrate.

The resistor layer 200 may be disposed on one surface of the insulating substrate 100, and may have one end and the other end opposing each other in a first direction W. The resistor layer 200 may be connected to the first and second terminals 300 and 400 disposed on the insulating substrate 100 and may exhibit a function of the resistor component 1000. The resistor layer 200 may have an area overlapping the first terminal 300 and the second terminal 400.

A distance between the one end and the other end of the resistor layer 200 opposing each other in the first direction W may be the same as a length of the insulating substrate in the first direction W. In this case, a maximum area of the resistor layer 200 may be secured. Also, the resistor layer may be formed collectively on unit substrates connected to each other on a strip substrate or a panel substrate, which may be advantageous in terms of a manufacturing process.

The resistor layer 200 may include a metal, a metal alloy, a metal oxide, or the like. In an example embodiment, the resistor layer 200 may include at least one of a Cu-Ni based alloy, an Ni-Cr based alloy, an Ru oxide, an Si oxide, or an Mn based alloy. As an example, the resistor layer 200 may be formed of a Pb-free alloy, a Pb-free paste including a Pb-free alloy oxide.

The resistor layer 200 may be formed by applying a conductive paste including a metal, a metal alloy, a metal oxide, or the like, on one surface 101 of the insulating substrate 100 by a screen printing method, or the like, and sintering the paste.

The first and second terminals 300 and 400 may be disposed on the insulating substrate 100 and may be spaced apart from each other to oppose each other in a second direction L perpendicular to the first direction W. The first terminal 300 and the second terminal 400 may be connected to the resistor layer 200. An element such as a surface or a direction is perpendicular to another element such as another surface or another direction may mean that the element is perfectly perpendicular to the another element. Alternatively, an element such as a surface or a direction is perpendicular to another element such as another surface or another direction may mean the element is substantially perpendicular to the another element in consideration of recognizable process errors which may occur during manufacturing or measurement.

The first terminal 300 and the second terminal 400 may include first and second internal electrode layers 310 and 410 disposed on one surface of the insulating substrate 100, spaced apart from each other to oppose each other in the second direction L, and connected to the resistor layer 200, and first and second external electrode layers 320 and 420 disposed on one side surface and the other side surface of the insulating substrate 100 opposing each other in the second direction L, respectively, and connected to the first and second internal electrode layers 310 and 410.

For example, the first terminal 300 may include the first internal electrode layer 310 including a first upper electrode 311 disposed on one surface 101 of the insulating substrate 100 and a first lower electrode 312 disposed on the other surface 102 of the insulating substrate 100, and the first external electrode layer 320 disposed on one side surface of the insulating substrate 100 and extending to each of one surface 101 and the other surface 102 of the insulating substrate 100 so as to cover the first internal electrode layer 310. The second terminal 400 may include the second internal electrode layer 410 including a second upper electrode 411 disposed on one surface 101 of the insulating substrate 100 and opposing the first upper electrode 311 in the second direction L and a second lower electrode 412 disposed on the other surface 102 of the insulating substrate 100 and opposing the first lower electrode 312 in the second direction L, and the second external electrode layer 420 disposed on the other side surface of the insulating substrate 100 and extending to each of one surface 101 and the other surface 102 of the insulating substrate 100 so as to cover the second internal electrode layer 410.

The internal electrode layers 310 and 410 may be formed by applying a conductive paste on one surface 101 and the other surface 102 of the insulating substrate 100 and sintering the paste. The conductive paste for forming the internal electrode layers 310 and 410 may include metal powder such as copper (Cu), silver (Ag), or nickel (Ni), a binder, and a glass composition. Accordingly, the internal electrode layers 310 and 410 may include glass and metal compositions.

The external electrode layers 320 and 420 may be formed by a vapor deposition method such as a sputtering method, a plating method, a paste printing method, or the like. When the external electrode layers 320 and 420 are formed by a plating method, although not illustrated in the diagrams, a seed layer for forming the external electrode layers 320 and 420 by a plating process may be formed on one side surface and the other side surface of the insulating substrate 100. The seed layer may be formed by an electroless plating method, a vapor deposition method such as a sputtering method, a printing method, or the like. The external electrode layers 320 and 420 may include at least one of titanium (Ti), chromium (Cr), molybdenum (Mo), copper (Cu), silver (Ag), nickel (Ni), tin (Sn), and alloys thereof.

The external electrode layers 320 and 420 may include a plurality of layers. As an example, the external electrode layer 320 may include a first layer disposed on one side surface of the insulating substrate 100, and a second layer disposed on the first layer and extending to each of one surface 101 and the other surface 102 of the insulating substrate 100. The first layer may be formed by printing a paste including metal powder such as copper (Cu), silver (Ag), nickel (Ni), or the like and curing or sintering the paste, by an electroless plating method, or by a vapor deposition method such as a sputtering method. The second layer may be formed by a plating method. The second layer may include a plurality of layers, a nickel (Ni) plated layer/a tin (Sn) plated layer, for example, but an example embodiment thereof is not limited thereto.

Protective layers G1 and G2 may be disposed on one surface 101 of the insulating substrate 100 to protect the resistor layer 200 from external impacts. For example, the first protective layer G1 may be disposed on one surface of the insulating substrate 100 to cover the resistor 200 to protect the resistor layer 200 in a process of forming the slits S1, S2, S3, S4, and S5 on the resistor layer 200. The second protective layer G2 may be disposed on the first protective layer G1 to protect the resistor layer 200 on which the slits S1, S2, S3, S4, and S5 are formed such that side surfaces of the resistor layer 200 are exposed, and the insulating substrate 100 of which one surface is externally exposed. The first protective layer G1 may be formed of a material including silicon (SiO2) or glass to protect the resistor layer 200 in the process of forming the slits S1, S2, S3, S4, and S5 on the resistor layer 200. The second protective layer G2 may be formed of a material including resin.

The slits S1, S2, S3, S4, and S5 extending in the first direction W may be formed in the resistor layer 200. The slits S1, S2, S3, S4, and S5 may include the slits S1, S3, and S5 formed on one end side, extending from one end of the resistor layer 200 in the first direction W, and the slits S2 and S4 formed on the other end side, extending from the other end of the resistor layer 200 and alternately disposed with the slits S1, S3, and S5 formed on the one end side in the second direction L on the resistor layer 200. The slits S1, S3, and S5 formed on the one end side may not extend to the other end of the resistor layer 200, and the slits S2 and S4 formed on the other end side may not extend to the one end of the resistor layer 200. Accordingly, the resistor layer 200 may have a pattern having a meander shape, including a plurality of extension patterns 211, 212, 213, 214, 215, and 216 formed in the first direction W and spaced apart from each other in the second direction L, and a plurality of conversion patterns 221, 222, 223, 224, and 225 formed from ends of the plurality of extension patterns 211, 212, 213, 214, 215, and 216 in the second direction L and connecting a plurality of the adjacent extension patterns 211, 212, 213, 214, 215, and 216 to each other.

The slits S1, S2, S3, S4, and S5 may increase an overall length of the resistor layer 200 such that withstand voltage properties of the resistor component 1000 may improve. In other words, by forming the slits S1, S2, S3, S4, and S5 on the resistor layer 200 within a limited area, an overall length of the resistor layer 200 may increase. Accordingly, even when the same overvoltage is applied to the first and second terminals 300 and 400, withstand voltage properties of the resistor component 1000 in the example embodiment may improve as compared to a general resistor component in which slits are not formed in a resistor layer.

A Pb-free resistor layer may have relatively low electrical properties such that a Pb-free resistor may have decreased withstand voltage properties as compared to a Pb based resistor layer. In the example embodiment, the slits S1, S2, S3, S4, and S5 may increase an overall length of the Pb-free resistor layer such that degradation of properties of materials may be reduced structurally.

The slits S1, S2, S3, S4, and S5 may be formed by printing a paste for forming a resistor layer on one surface of the insulating substrate 100 in a form of a meander, or by printing a paste for forming a resistor layer on overall one surface of the insulating substrate 100, sintering the paste, and partially removing the resistor layer through an additional process. It may be difficult to form a resistor layer having a meander shape using the paste for forming a Pb-free resistor layer by a printing method due to fluidity of the paste. Accordingly, in the example embodiment, the resistor layer 200 having a pattern of a meander shape may be formed by the latter method.

For example, the resistor layer 200 may be formed by printing the paste for forming a Pb-free resistor layer on overall one surface of the insulating substrate 100 and sintering the paste, the first protective layer G1 for protecting the resistor layer 200 may be formed, and the slits S1, S2, S3, S4, and S5 may be formed. The slits S1, S2, S3, S4, and S5 may be formed on the resistor layer 200 and the first protective layer G1 by irradiating laser beams, for example, but an example embodiment thereof is not limited thereto. By performing the above-described process, the slits S1, S2, S3, S4, and S5 may extend to the resistor layer 200 and also to the first protective layer G1. Also, a side surface of the resistor layer 200 forming an internal wall of each of the slits S1, S2, S3, S4, and S5 and a side surface of the first protective layer G1 forming the internal wall of each of the slits S1, S2, S3, S4, and S5 may be formed on the same level. The side surface of the resistor layer 200 forming an internal wall of each of the slits S1, S2, S3, S4, and S5 may be perpendicular to one surface of the insulating substrate 100. As the side surface of the resistor layer 200 is perpendicular to one surface of the insulating substrate 100, resistive properties may become precise and constant.

A ratio of a length B and C of the slits S1, S2, S3, S4, and S5 in the first direction W to a length A of the resistor layer 200 in the first direction W may be greater than 0.7 and equal to or lower than 0.9. More particularly, a ratio of a length A-B and A-C of each of the plurality of conversion patterns 221, 222, 223, 224, and 225 in the first direction W to the length A of the resistor layer 200 in the first direction W may be equal to or greater than 0.1 and lower than 0.3. When the former ratio is equal to or lesser than 0.7, resistive properties may not be uniform such that a defect rate may increase. When the former ratio exceeds 0.9, a line width of each of the conversion patterns 221, 222, 223, 224, and 225 may decrease such that it may be difficult to form the conversion patterns 221, 222, 223, 224, and 225, or resistive properties of the resistor layer 200 may not be uniform. A ratio of an overlapped length D, in the first direction W, between the slits S1, S3, and S5 and the slits S2 and S4, to the length A of the resistor layer 200 in the first direction W may be greater than 0.4 and equal to or less than 0.8.

In one example, the lengths, A, B, and C may be measured in a length-width (L-W) plan view or in a length-width (L-W) cross-section by an optical micrograph method, but may also be measured by other measurement methods appreciated by one skilled in the art.

For example, the length B of the slit S1 in the first direction W may refer to a distance from one point of a line segment corresponding to one surface of the insulating substrate 100 (an upper surface of the insulating substrate 100 based on the view in FIG. 3) at which the slit S1 is opened to the other point at which a normal contacts a line segment corresponding to the other surface of the conversion pattern 221 (an upper surface of the conversion pattern 221 based on the view in FIG. 3), when the normal extends from one point to the other point in the width direction W, based on an optical micrograph of the plan diagram of FIG. 3. The length B of each of the slits S3 and S5 in the first direction W may be obtained by the above-mentioned of obtaining the length B of the slit S1. The length C of each of the slits S2 and S4 in the first direction W may be obtained similarly.

The length A of the resistor layer 200 in the first direction W may refer to a distance from one point of a line segment corresponding to one surface of the conversion pattern 222 (an upper surface of the conversion pattern 222 based on the view in FIG. 3) to the other point at which a normal contacts a line segment corresponding to one surface of the conversion pattern 221 (an lower surface of the conversion pattern 221 based on the view in FIG. 3), when the normal extends from one point to the other point in the width direction W, based on an optical micrograph of the plan diagram of FIG. 3.

FIGS. 4A to 4C are diagrams illustrating resistance value conversion rates of a plurality of samples according to changes in applied voltage. FIG. 4A illustrates resistance value conversion rates according to changes in applied voltage of a plurality of samples in which the ratio of the length B and C of the slits S1, S2, S3, S4, and S5 in the first direction W to the length A of the resistor layer 200 in the first direction W was 0.7. FIGS. 4B and 4C illustrate an example in which the ratio was changed to 0.8 and 0.9. The applied voltages in FIGS. 4A to 4C were 2.5 times, 3 times, 3.5 times and 4 times a rated voltage RV, and "USL" refers to an upper limit of an allowable range of a resistance value conversion rate, and "LSL" refers to a lower limit of an allowable range of a resistance value conversion rate. A sample which exhibited a value lower than the lower limit LSL of an allowable range of a resistance value conversion rate was determined as a defect (NG) when an applied voltage of 2.5 times the rated voltage RV was applied. Referring to FIG. 4A to 4C, when the ratio was 0.7, a defect occurred, but when the ratio was 0.8 and 0.9, a defect did not occur.

In FIG. 4A in which the ratio was equal to or lower than 0.7, a minimum distance D between ends of the slits S1, S2, and S3 formed on the one end side and ends of the slits S2 and S4 formed on the other end side was reduced such that an overall length of the resistor layer 200 may be relatively reduced, and a hot spot may be adjacently disposed, which may lead to a defect. As an overall length of the resistor layer 200 was relatively reduced such that a great amount of electrical load was applied per unit area, and the resistance value conversion rate increased. Also, as a distance between hot spots decreased, regions in which heat was generated were concentrated such that the resistance value conversion rate increased.

According to the aforementioned example embodiment, a resistance value of the resistor layer of the resistor component may be controlled in a precise manner.

Also, withstand voltage properties of the resistor component may improve.

While the exemplary embodiments have been shown and described above, it will be apparent to those skilled in the art that modifications and variations could be made without departing from the scope of the present invention as defined by the appended claims.

What is claimed is:

1. A resistor component, comprising:
an insulating substrate;
a resistor layer disposed on one surface of the insulating substrate and having one end and the other end opposing each other in a first direction; and
first and second terminals disposed on the insulating substrate and spaced apart from each other to oppose each other in a second direction perpendicular to the first direction, and connected to the resistor layer,
wherein a slit in the resistor layer extends in the first direction, and
wherein a ratio of a length of the slit in the first direction to a length of the resistor layer in the first direction is greater than 0.7 and equal to or lower than 0.9.

2. The resistor component of claim 1, wherein the slit includes a first slit extending from the one end of the resistor layer in the first direction, and a second slit extending from the other end of the resistor layer in the first direction and to be alternately disposed with the first slit in the second direction.

3. The resistor component of claim 2, wherein a ratio of an overlapped length between the first slit and the second slit in the first direction to a length of the resistor layer in the first direction is greater than 0.4 and equal to or less than 0.8.

4. The resistor component of claim 2, wherein the slit includes a first slit extending in the first direction from a first side surface of the insulating substrate, and a second slit extending in the first direction from a second side surface of the insulating substrate opposing the first side surface.

5. The resistor component of claim 1, wherein a side surface of the resistor layer as at least a portion of an internal wall of the slit is perpendicular to the one surface of the insulating substrate.

6. The resistor component of claim 1, further comprising:
a first protective layer disposed on the resistor layer,
wherein the slit is configured to extend to the first protective layer.

7. The resistor component of claim 6, wherein a side surface of the resistor layer as a portion of the internal wall of the slit and a side surface of the first protective layer as another portion of the internal wall of the slit are disposed on the same level.

8. The resistor component of claim 1, wherein the resistor layer includes a Pb-free material.

9. The resistor component of claim 1, wherein the first and second terminals include:
first and second internal electrode layers disposed on one surface of the insulating substrate, spaced apart from each other to oppose each other in the second direction, and connected to the resistor layer; and
first and second external electrode layers disposed on both side surfaces of the insulating substrate opposing each other in the second direction, respectively, and connected to the first and second internal electrode layers.

10. The resistor component of claim 1, wherein a length of the insulating substrate in the first direction is the same as a length of the resistor layer in the first direction.

11. A resistor component, comprising:
an insulating substrate;
a resistor layer disposed on one surface of the insulating substrate; and
first and second internal electrode layers disposed on the one surface of the insulating substrate, spaced apart from each other, and connected to the resistor layer,
wherein the resistor layer includes:
a plurality of extension patterns disposed along a first direction, respectively, and spaced apart from each other in a second direction perpendicular to the first direction; and
a plurality of conversion patterns extending between end portions of the plurality of extension patterns along the second direction and connecting a plurality of adjacent extension patterns to each other, and
wherein a ratio of a length of each of the plurality of conversion patterns in the first direction to a length of the resistor layer in the first direction is equal to or greater than 0.1 and less than 0.3.

12. The resistor component of claim 11, wherein opposing side surfaces of the plurality of adjacent extension patterns are perpendicular to the one surface of the insulating substrate.

13. The resistor component of claim 11, wherein each of the plurality of conversion patterns extends from one of first and second side surfaces of the insulating substrate opposing each other in the first direction.

* * * * *